United States Patent [19]

Hickey

[11] Patent Number: 4,707,023

[45] **Date of Patent: * Nov. 17, 1987**

[54] FOLD-AWAY CHAIR

[75] Inventor: William S. Hickey, Grosse Pointe Farms, Mich.

[73] Assignee: Willsboro Wood Products, Detroit, Mich.

[ * ] Notice: The portion of the term of this patent subsequent to Jan. 13, 2004 has been disclaimed.

[21] Appl. No.: 929,637

[22] Filed: Nov. 12, 1986

Related U.S. Application Data

[63] Continuation-in-part of Ser. No. 791,521, Oct. 25, 1985, Pat. No. 4,635,998.

[51] Int. Cl.[4] ..... A47C 4/00

[52] U.S. Cl. ..... 297/31; 297/35; 297/31

[58] Field of Search ..... 297/31, 35, 39, 21, 297/27, 28

[56] References Cited

U.S. PATENT DOCUMENTS

| | | | |
|---|---|---|---|
| 1,919,820 | 7/1933 | Ashleman | 297/31 X |
| 2,222,296 | 11/1940 | Luiken | 297/31 |
| 2,490,884 | 12/1949 | Rau | 297/31 X |
| 2,600,626 | 6/1952 | Ellingson | 297/35 |
| 2,618,317 | 11/1952 | Vanderminden | 297/21 |
| 2,638,970 | 5/1953 | Harber | 297/39 |

FOREIGN PATENT DOCUMENTS

| | | | |
|---|---|---|---|
| 1089750 | 11/1980 | Canada | 297/39 |
| 999695 | 10/1957 | France | 297/31 |
| 500634 | 2/1939 | United Kingdom | 297/39 |
| 677907 | 8/1952 | United Kingdom | 297/21 |
| 819344 | 9/1959 | United Kingdom | 297/28 |

*Primary Examiner*—Francis K. Zugel

*Attorney, Agent, or Firm*—Barnes, Kisselle, Raisch, Choate, Whittemore & Hulbert

[57] ABSTRACT

A fold-away chair capable of being pivoted from a position of use to a fully collapsed position. The chair has a combined seat bottom and a rear leg assembly, a seat back assembly, a pair of front legs, a pair of arm rests, and a sliding pivot assembly to facilitate folding. The combined seat bottom and rear leg assembly comprises a pair of laterally spaced side rails having a transverse load-bearing member at the front ends. When the chair is in its position of use, this load-bearing member bears upon a transverse load-bearing member connecting the front legs. Pins connect the front legs to the forward ends of the side rails to lock the chair in its position of use. When these pins are removed, the chair may be folded to a collapsed position.

1 Claim, 8 Drawing Figures

FOLD-AWAY CHAIR

REFERENCE OF RELATED APPLICATION

This application is a continuation-in-part of my prior co-pending application Ser. No. 791,521 filed Oct. 25, 1985, now U.S. Pat. No. 4,635,998.

This invention relates generally to chairs and refers more particularly to a fold-away chair capable of being swung from a position of use to a collapsed position.

SUMMARY OF THE INVENTION

The fold-away chair of this invention comprises a combined seat bottom and rear leg assembly, a seat back, front legs, a pair of arm rests, and a pair of sliding pivots to facilitate folding.

The combined seat bottom and rear leg assembly comprises laterally spaces side rails having front seat bottom portions and rear leg portions with seating connecting the front seat bottom portions. A transverse load-bearing member connects the front ends of the front seat bottom portions of the rails.

The front legs are pivoted to the front ends of the seat bottom portions of the side rails. A second load-bearing member connects the front legs.

The seat back has upper and lower transverse bars. The rear ends of the arm rests are pivoted to the upper transverse bar. The front ends of the arm rests are pivoted to the upper ends of the front legs.

The sliding pivots are carried by the lower transverse bar of the seat back assembly and slide in grooves in the rear leg portions of the side rails.

When the chair is in its position of use with its front legs substantially vertical, the load-bearing member carried by the side rails bears upon the load-bearing member carried by the front legs. The chair can be folded to a collapsed position in which the front legs are substantially horizontal and extend parallel to the side rails.

Other objects and features of the invention will become more apparent as the following description proceeds, especially when considered with the accompanying drawings.

DETAILED DESCRIPTION

Figure 1:
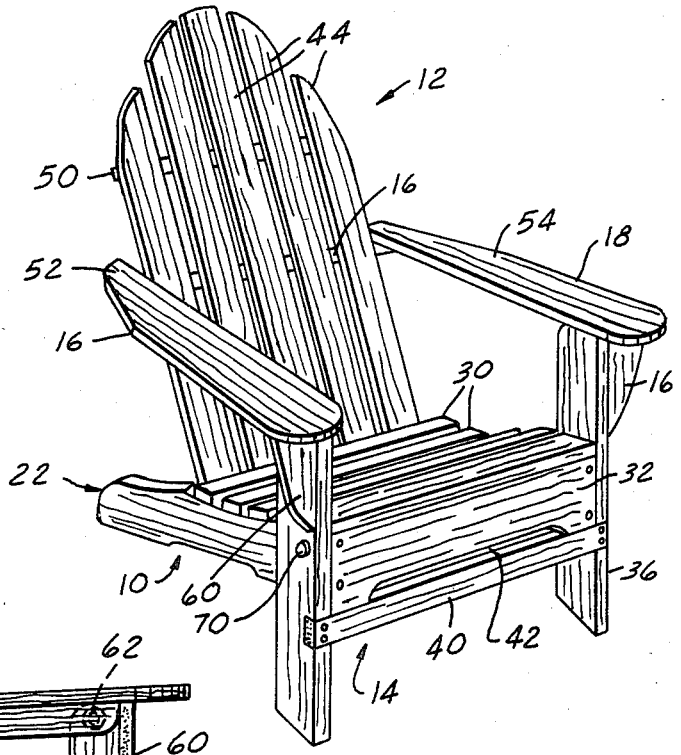
FIG. 1 is a perspective view of a chair constructed in accordance with the invention and shown in its position of use.

Referring now more particularly to the drawings, the chair comprises a combined seat bottom and leg assembly 10, a seat back assembly 12, a front leg assembly 14, a pair of arm rests 16 and 18, and a sliding pivot assembly 20. The chair is preferably of substantially all wood construction, except for certain connecting pins and/or pivots.

The combined seat bottom and rear leg assembly 10 comprises a pair of laterally spaced parallel side rails 22 and 24. Rails 22 and 24 are flat board-like members. When the chair is supported on a horizontal surface in its position of use shown in FIGS. 1 and 2, the rails are disposed in vertical planes and are inclined downwardly from the front ends to the rear ends where they contact the supporting surface. The rear leg portions 26 of the rails extend from the rear ends to about the midpoint of the rails and the front seat bottom portions 28 extend from about the midpoint to the front ends of the rails. A plurality of spaced transverse slats 30 are secured to the upper edges of the front seat bottom portions 28 of the rails to connect the rails together and to provide a supporting seat for the chair occupant. A transverse load-bearing member 32 extends across the front of the chair and connects the front ends of the front seat bottom portions 28 of the side rails. This transverse load-bearing member 32 is a flat plate like member which is disposed in a vertical plane when the chair is supported on a horizontal surface in its position of use.

The front leg assembly 14 comprises a pair of laterally spaced parallel front legs 34 and 36. These front legs 34 and 36 are disposed vertically when the chair is supported on a horizontal surface in its position of use. Pivots 38 provided by nut and bolt asemblies connect the front legs near the midpoint of their lengths to the front ends of the seat bottom portions 28 of the rails 22 and 24. These pivots 38 extend transversely of the chair and are disposed on a common horizontal axis. A transverse load-bearing member or bar 40 connects the front legs 34 and 36 just below the midpoints in the length thereof, being disposed in recesses in the front edges of the legs 34 and 36. In the position of use of the chair, the load-supporting bar 40 of the front leg assembly 14 is directly beneath the load-bearing member 32 across front of the side rails so that the load-bearing member 32 engages and bears upon the load-bearing bar 40 at a point well below the slats 30 to transmit the weight of the person occupying the chair to the legs. It will be noted that the load-bearing member 32 is recessed where indicated at 42 to provide finger clearance when either folding the chair to its position of use or to its collapsed position.

The seat back assembly 12 comprises a plurality of laterally spaced longitudinal slats 44 connected near the midpoint by a transverse bar 46. The longitudinal slats are also connected near their lower ends by a transverse bar 48 and near the upper ends by a transverse bar 50. Bars 46 and 50 are on the rear side of the seat back assembly 12, and bar 48 is on the front side.

The arm rests 16 and 18 are in the form of elongated flat board-like members which extend parallel to one another and, in the position of use of the chair when supported on a horizontal surface, extend generally horizontally or perhaps with a slight downward and rearward slope. An elongated rib 54 extends lengthwise of each arm rest, being secured to the under surface thereof. Each leg 34, 36 has a laterally outwardly extending plate or rib 60 secured to the upper end portion thereof which abuts the front end of rib 54 to stabilize the chair when it is in the upright position of use.

The rear ends of the arm rests are pivoted to the seat back assembly 12 by means of aligned transverse pins 61 connecting the ribs 54 to the ends of the transverse bar 46. The front ends of the arm rests are pivoted to the front leg assembly by means of aligned transverse pins 62 connecting the upper ends of the legs 34 and 36 to the front ends of the rib 54 of the arm rests.

The sliding pivot assembly 20 comprises a pair of pivot pins 63 and 64, one on each end of the transverse bar 48 of the seat back assembly, and a pair of grooves or tracks 65 and 66, one in the inner surface of each side rail 22, 24. The pins 63 and 64 slide in the respective tracks 65 and 66. The tracks are arcuate and elongated in the direction of length of the rails and terminate at their front ends in downwardly and forwardly extending locking portions 67. The pins 63 and 64 may be separate elements secured to the bar 48, but preferably they are formed integrally with the bar. Thus the bar, which is wooden, may be cut or contoured to form terminal projections providing the pins 63, 64.

Figure 2:
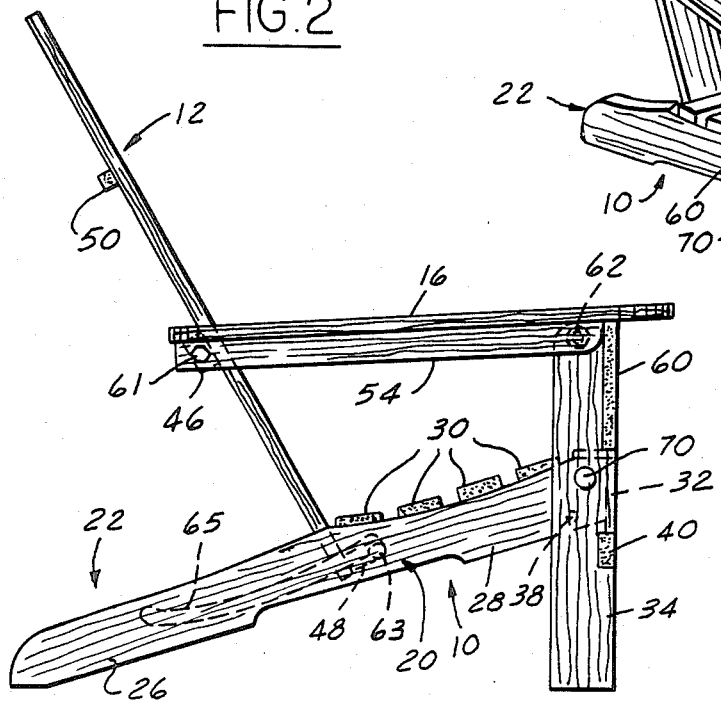
FIG. 2 is a side elevational view of the chair shown in FIG. 1.
Figure 4:
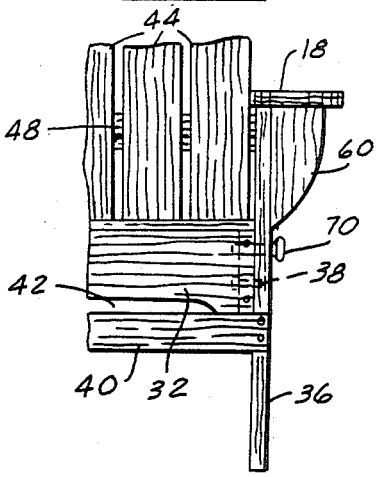
FIG. 4 is a fragmentary front elevational view.
Figure 3:
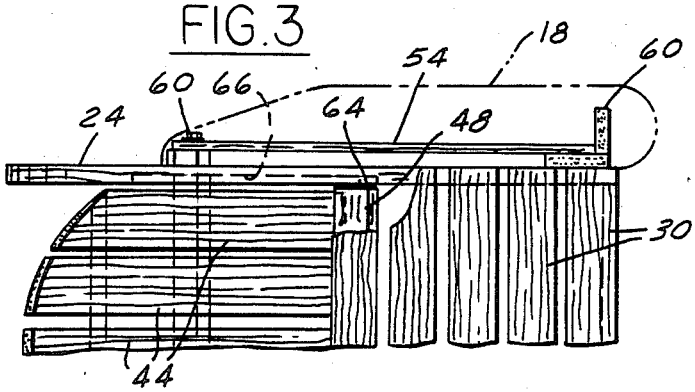
FIG. 3 is a top plan view of one side of the chair, the opposite side being a mirror image.
Figure 5:
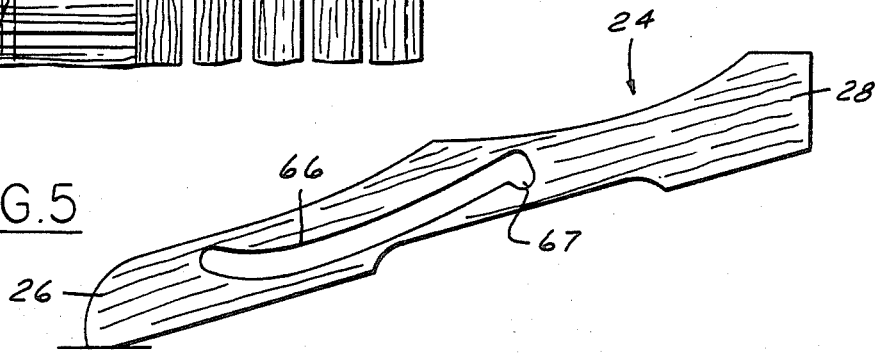
FIG. 5 is a view of the inner side of one of the side rails.

Pins 70 extend through the front legs 34 and 36 near the pivots 38 and into the front ends of the seat bottom portions 28 of the side rails to lock the chair in its position of use shown in FIGS. 1 and 2. These pins are removable and when removed permit the chair to be folded to its collapsed position.

The construction of the chair and the arrangement and relationship of the pivots 38, 61, and 62, and the sliding pivot pins 63 and 64, is such that in the position of use of the chair on a horizontal surface shown in FIGS. 1 and 2, the seat back assembly 12 extends upwardly and rearwardly with the pivot pins 63 and 64 received and retained in locking portions 67 of tracks 65 and 66 in the side rails 22 and 24 to transfer the load on the seat back assembly to the rails.

Figure 6:
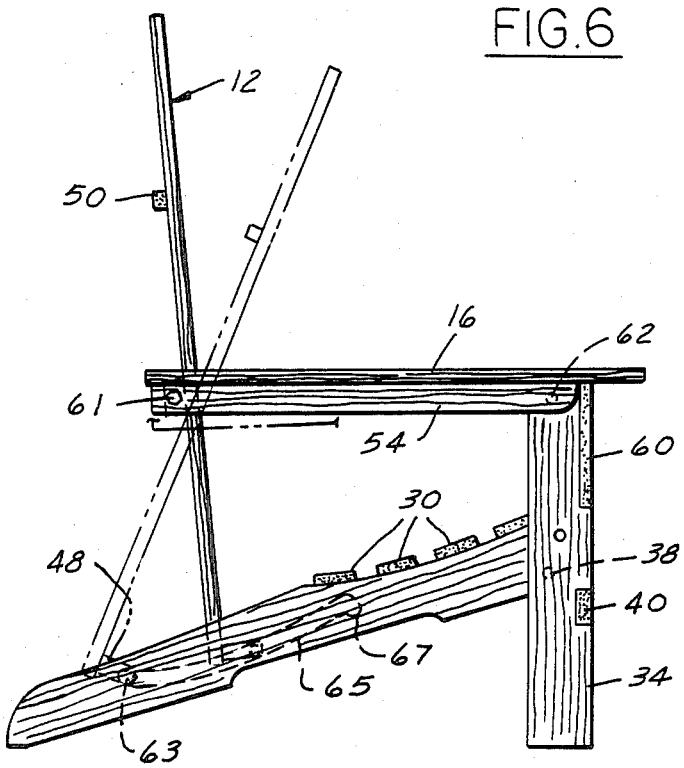
FIG. 6 is a side elevational view showing the chair in a partially folded position in solid lines, and showing it folded further towards collapsed position in broken lines.
Figure 7:
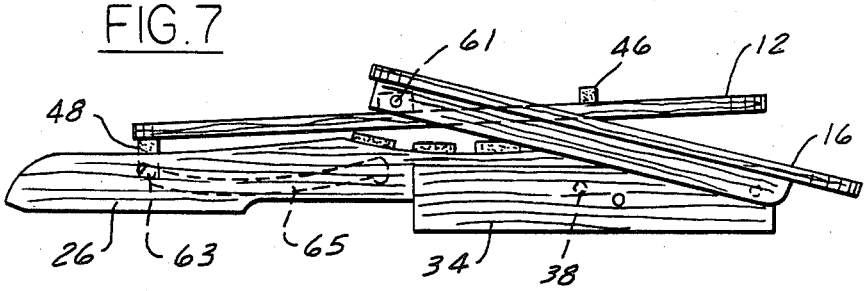
FIG. 7 is a side elevational view of the chair shown fully collapsed.
Figure 8:
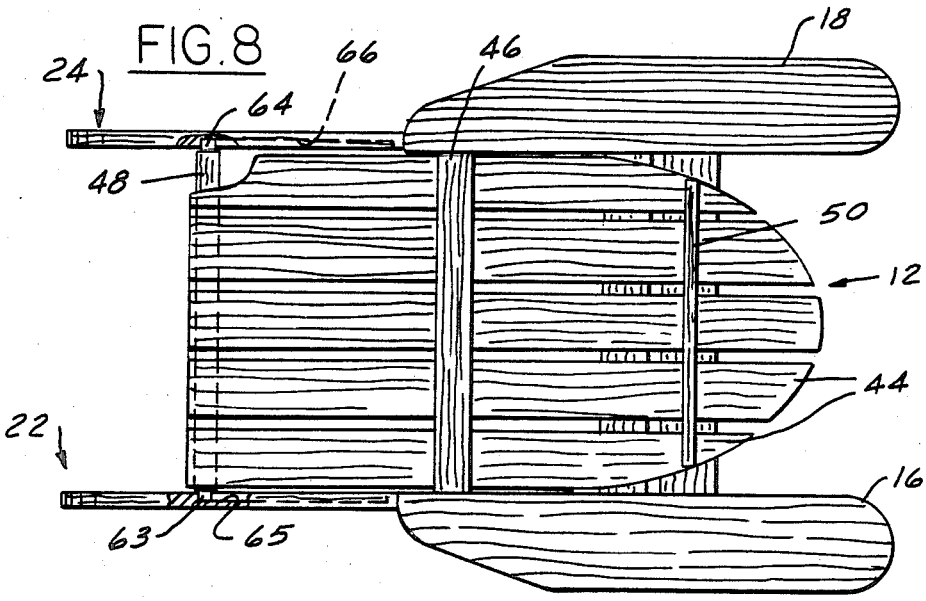
FIG. 8 is a top plan view of the chair as it appears in its collapsed position.

In order to fold the chair from its position of use to the fully collapsed position of FIGS. 7 and 8, the upper part of the seat back assembly 12 may be grasped and a foot placed upon one of the rear leg portions 26 near the point where it engages the ground or supporting surface. Then by pushing forwardly, the seat back assembly 12 may be moved to an intermediate vertical position, during which time the chair will move towards a partially folded condition as seen in solid lines in FIG. 6. At the beginning of this movement, the sliding pivot pins 63 and 64 lift out of the locking portions 67 of tracks 65 and 66 and start sliding rearwardly. Since the locking portions 67 slope downwardly and forwardly, the pivot pins 63 and 64 cam out of the locking portions when the seat back assembly is pushed forwardly. Continued forward pressure on the seat back assembly 12 causes the chair to fold to a fully collapsed position shown in FIGS. 7 and 8, during which time the sliding pivot pins 63 and 64 slide to the extreme rear ends of the tracks 65 and 66. When the chair is fully collapsed, the front legs 34 and 36 are substantially parallel to the side rails 22 and 24. A person may find that when collapsing the chair, it may be helpful at the same time to grasp the front of the seat bottom portion. Clearance 42 for the fingers makes it easy to grasp the front of the chair in this manner. The chair can be easily unfolded and returned to its position of use by a reverse swinging of the seat back assembly 12.

I claim:

1. A fold-away chair adapted to be pivoted from a position of use to a collapsed position, comprising a combined seat bottom and rear leg assembly, a seat back assembly, a front leg assembly, a pair of arm rests, and a sliding pivot assembly to facilitate folding, said combined seat bottom and rear leg assembly comprising laterally spaced side rails having front seat bottom portions and rear leg portions, transverse slats connecting the front seat bottom portions of said side rails, a first transverse load-bearing member connecting the front ends of the front seat bottom portions of said side rails, said front leg assembly comprising laterally spaced front legs, first means pivoting said front legs near their midpoints to the front ends of the seat bottom portions of said side rails, a second transverse load-bearing member connecting said front legs beneath said first pivot means, said seat back assembly comprising longitudinal slats connected near their midpoints by an upper transverse bar and connected near their lower ends by a lower transverse bar, each arm rest having an elongated rib secured to the underside thereof and extending lengthwise thereof from a point near the rear end of said arm rest to a point short of the front end thereof, each front leg having a transverse plate at the upper end thereof, second means pivoting the rear ends of the elongated ribs of said arm rests to said upper transverse bar of said seat back assembly and third means pivoting the front ends of said elongated ribs to the upper ends of said respective front legs, said sliding pivot assembly comprising sliding pivot pins on the ends of said lower transverse bar of said seat back assembly, arcuate tracks on said side rails extending generally lengthwise thereof in which said pivot pins are slidably received, said pivot pins providing the sole means of transferring the load of said seat back assembly and of the rear end portions of said arm rests to said side rails, said tracks having downwardly and forwardly sloping terminal locking portions at their front ends in which said sliding pivot pins are received and retained in the position of use of said chair, the slope of said terminal locking portions being such that said sliding pivot pins lift out of said locking portions with a camming action when said seat back assembly is pushed forwardly to initiate the folding of said chair to a collapsed position, and releasable pins engaging said front legs and the front ends of the seat bottom portions of said rails to lock said chair in its position of use in which, when said chair is supported on a horizontal surface, said front legs are substantially vertical and their transverse plates abut the front ends of said elongated ribs of said arm rests, said combined seat bottom and rear leg assembly slopes downwardly from front to rear, and said first loading-bearing member bears upon said second loading-bearing member at a point well below said transverse slats of said combined seat bottom and rear leg assembly, said chair being foldable when said releasable pins are released to a collapsed position in which, when said collapsed chair is supported on a horizontal surface, said front legs are substantially horizontal and extend generally parallel to said side rails.

* * * * *